US005683255A

United States Patent [19]

Menze

[11] Patent Number: 5,683,255

[45] Date of Patent: Nov. 4, 1997

[54] RADIO FREQUENCY CONNECTOR ASSEMBLY

[76] Inventor: Marion John Menze, 360 Sanders Rd., Northbrook, Ill. 60062

[21] Appl. No.: 160,768

[22] Filed: Dec. 3, 1993

[51] Int. Cl.[6] ..... H01R 9/09

[52] U.S. Cl. ..... 439/63; 439/83

[58] Field of Search ..... 439/63, 825, 887, 439/581, 33, 607, 610, 65, 578, 700, 824, 246, 248; 228/180.5; 29/874

[56] References Cited

U.S. PATENT DOCUMENTS

| | | | |
|---|---|---|---|
| 1,672,693 | 6/1928 | Scott | 439/33 X |
| 3,889,364 | 6/1975 | Krueger | 439/874 |
| 4,072,378 | 2/1978 | Lockbrunner et al. | 439/357 |
| 4,125,308 | 11/1978 | Schilling | 439/63 |
| 4,437,604 | 3/1984 | Razon et al. | 228/180.5 |
| 4,556,265 | 12/1985 | Cunningham | 439/581 X |
| 4,669,805 | 6/1987 | Kosugi et al. | 439/581 |
| 4,715,821 | 12/1987 | Axell | 439/63 X |
| 4,802,862 | 2/1989 | Seidler | 439/83 |
| 4,923,405 | 5/1990 | Munsterman et al. | 439/161 |
| 4,925,083 | 5/1990 | Farassat et al. | 228/180.5 |
| 4,984,990 | 1/1991 | Lindahl | 439/63 |
| 5,123,863 | 6/1992 | Frederick et al. | 439/581 X |
| 5,133,676 | 7/1992 | Hutchison et al. | 439/581 |
| 5,136,122 | 8/1992 | Kwitkowski et al. | 439/887 X |
| 5,148,135 | 9/1992 | Stein | 439/65 |
| 5,263,880 | 11/1993 | Schwarz et al. | 439/733.1 |

FOREIGN PATENT DOCUMENTS

| | | | |
|---|---|---|---|
| 0316464 | 12/1988 | Japan | 29/874 |
| 401082538 | 3/1989 | Japan | 228/180.5 |
| 0309360 | 12/1989 | Japan | 29/874 |
| 4256330 | 9/1992 | Japan | 228/180.5 |
| 2151529 | 7/1985 | United Kingdom | 228/180.5 |

OTHER PUBLICATIONS

Jul. 1990 England "Surface Solder Harcon Connector" Research Disclosure.

*Primary Examiner*—Neil Abrams
*Assistant Examiner*—Barry Matthew L. Standig
*Attorney, Agent, or Firm*—Daniel C. Crilly

[57] ABSTRACT

An electrical connector assembly (100) that adaptively couples a radio frequency signal between two ports includes two electrically conductive elements (102, 104), a compliant member (106), and a matable housing (116). A first electrically conductive element (102) is disposed substantially within the matable housing (116) to provide connectivity to a first port. A circularly formed metal element (104) provides connectivity to a second port. The circularly (e.g.. cylindrically) formed metal element may be mounted to a printed circuit board by soldering a solderable surface (114) on an underside of the circularly formed metal element to a trace on the printed circuit board. The compliant member (106) is connected to both electrically conductive elements (102, 104) to provide mechanical stress relief therebetween during operation of the electrical connector assembly (100).

15 Claims, 1 Drawing Sheet

RADIO FREQUENCY CONNECTOR ASSEMBLY

FIELD OF THE INVENTION

The present invention relates generally to electrical connector assemblies and, in particular, to an electrical connector assembly that adaptively couples a radio frequency signal between two ports.

BACKGROUND OF THE INVENTION

Radio frequency connectors are well known in the art. They typically comprise a solid, straight center pin, an extruded dielectric material, and a matable housing. The center pin is typically fabricated from copper, or beryllium copper, and includes a plating of gold, or silver, on its surface to aid in the prevention of intermetallic formations. For RF applications, the dielectric material typically comprises teflon, although polystyrene or polypropylene might also be used in low power connectors. The, matable housing is usually electrically conductive and is typically fabricated from a selected one of a variety of non-magnetic metals, such as copper or brass. Similar to the center pin, the matable housing may be plated with gold, silver, or nickel to reduce oxidation and metal migration.

Assembly of the RF connector typically occurs in the following manner: the center pin is inserted into the dielectric material such that a matable portion of the center pin is substantially surrounded by the dielectric material. The combination of the center pin and the dielectric material is then inserted into the matable housing such that the dielectric material and the matable portion of the center pin are retained by the matable housing. Upon fabrication, a non-matable portion of the center pin may extend outside the matable housing, on the housing's non-matable side, to facilitate an electrical connection to a substrate or other electrical component.

The matable housing and the matable portion of the center pin are structurally designed to enable electrical coupling to other matable housings and center pins. The matable housing typically includes threads, pins, or tapered areas that provide an electrical connection between the matable housing and other similar housings, when the matable housing is conjoined with the other housings via screwing, turning, or pushing motions, respectively. The matable portion of the center pin comprises a known jack (i.e., female member), or plug (i.e., male member), which enables connectivity with other plugs, or jacks, respectively. For example, a female N-style connector typically includes a housing with a threaded cylinder portion and a center pin with a jack on its matable end. Similarly, a male N-connector typically includes a housing with a threaded coupling nut and a center pin with a plug on its matable end. Thus, the male and female N-connectors are conjoined when the male connector's coupling nut is screwed onto the female connector's threaded cylinder portion, which simultaneously inserts the male connector's plug into the female connector's jack. Alternate techniques include the so-called one-quarter-turn, and blind-mate techniques, which utilize well known turning and pushing motions, respectively, to conjoin the male and female connectors.

In a typical configuration, the assembled RF connector is coupled to a coaxial cable at its matable end and has the exposed, non-matable portion of the center pin soldered to a copper trace on a substrate, such as a printed circuit board. Thus, the RF connector is used to couple an RF signal from the printed circuit board to the coaxial cable during operation of an electrical device that incorporates the RF connector and the printed circuit board. The electrical device may be a mobile radio, a portable radio, a base station, any electrical circuitry used therein such devices, or any peripheral circuitry utilized therewith such devices.

During operation of the electrical device, RF energy that is transferred from the printed circuit board to the coaxial cable, via the RF connector, heats the center pin due to the finite resistance of the center pin at the particular operating frequency. The heating causes the center pin to expand in accordance with its coefficient of thermal expansion. The mount of heating—and the resultant amount of center pin expansion—is dependent upon the amount of incident RF energy (i.e., power) and the frequency of operation. Likewise, when the electrical device becomes inactive, the RF energy is removed from the center pin and the center pin contracts, as it cools, until it reaches its original physical dimensions. Since the center pin is a straight, rigid entity, its expansion and contraction necessarily induce mechanical stresses on the solder joint that connects the center pin to the printed circuit board.

During the operational life of particular electrical devices, such as high power frequency modulated (FM) transmitters, the RF connector's center pin may encounter thousands of heating and cooling cycles as, for example, the RF energy is applied and removed for each transmission. Each cycle creates stress on the aforementioned solder joint, thus producing solder joint fatigue and eventual cracking of the solder joint. Thus, existing RF connectors provide an unreliable connection when the exposed portion of the center pin is soldered to a substrate.

Therefore, a need exists for an electrical connector assembly that adaptively couples an RF signal between two ports, while maintaining the integrity of a solder joint used to provide connectivity between the assembly's center pin and one of the ports.

DESCRIPTION OF A PREFERRED EMBODIMENT

Figures 1, 2:
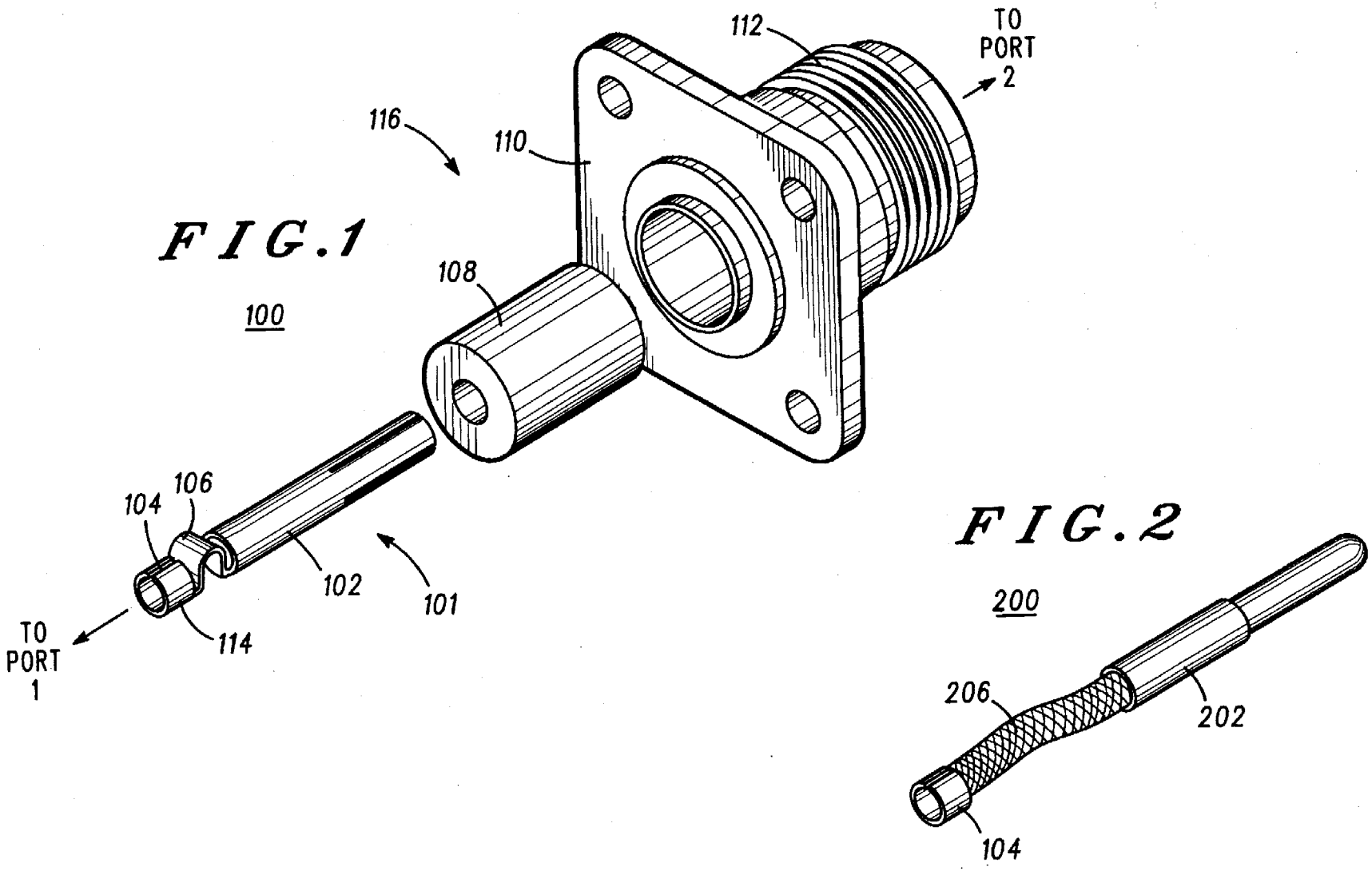
FIG. 1 illustrates an exploded perspective view of a preferred electrical connector assembly, in accordance with the present invention.
FIG. 2 illustrates an alternate embodiment of a center pin assembly, in accordance with the present invention.

Generally, the present invention provides an electrical connector assembly for adaptively coupling a radio frequency (RF) signal between two ports. This is accomplished by a first electrically conductive means disposed within a matable housing to provide connectivity to a first port, while a second electrically conductive means provides connectivity to a second port. A compliant means is operably coupled to both electrically conductive means to provide mechanical stress relief therebetween during operation of the electrical connector assembly. By employing a mechanically compliant element in this manner, the present invention provides a reliable RF interconnection over wide variations in temperature that may be caused, for example, by repetitious electrical impulses.

The present invention can be more fully described with reference to FIGS. 1–2. FIG. 1 illustrates an exploded perspective view of a preferred electrical connector assembly 100, in accordance with the present invention. The preferred electrical connector assembly 100 comprises a center pin assembly 101, a dielectric medium 108, and a matable housing 116. The center pin assembly 101 comprises a first electrically conductive element 102, a second electrically conductive element 104, and a compliant member 106 that is operably coupled to both electrically conductive elements 102, 104. As depicted in FIG. 1, the first electrically conductive element 102 comprises a known jack (i.e., female) style pin; however, in an alternate embodiment, the first electrically conductive element 102 might comprise a known plug (i.e., male) style pin. The plug and jack style pins typically comprise a copper composition that is plated with nickel and gold.

The second electrically conductive element 104 preferably comprises a piece of circularly (e.g. cylindrically as shown in FIG. 1) formed metal, such as copper, tin, etc., that includes a solderable surface 114 on its underside. In alternate embodiments, the second electrically conductive element 104 might comprise a piece of substantially flat metal, a plug style pin, a jack style pin, or any other equivalent means for providing electrical connectivity to an RF port.

In a preferred embodiment, the compliant member 106 comprises a piece of substantially flat metal formed to approximate the geometric shape of the Greek letter "omega" (as illustrated in FIG. 1). This particular construction adds flexibility to the center pin assembly 101 for reasons later described.

Fabrication of the center pin assembly 101, in accordance with a preferred embodiment of the present invention, may be accomplished in the following manner: the two electrically conductive elements 102, 104 are rigidly positioned substantially adjacent to, and at opposing ends of, the compliant member 106. The electrically conductive elements 102, 104 are then brazed, or soldered, to the compliant member 106 to produce a mechanically stable, electrically conductive assembly.

The preferred electrical connector assembly 100 is fabricated using a known assembly procedure, such as the procedure used to assemble an Amphenol Incorporated 82-368-1010 N-style jack connector. Thus, no further discussion will be presented except to facilitate an understanding of the present invention.

Upon fabrication of the preferred electrical connector assembly 100, the first electrically conductive element 102 and the dielectric medium 108 are disposed substantially within the matable housing 116. In a high power RF application (i.e., in excess of 10 watts incident at either RF port), the dielectric medium 108 typically comprises polytetrafluoroethylene (PTFE), commonly known as teflon; however, in other applications, dielectrics such as air, polystyrene, or polypropylene may also used. The matable housing 116 preferably comprises an N-connector housing, such as that used in the Amphenol Incorporated 82-368-1010 connector, which includes a base portion 110 and a threaded cylinder portion 112. However, in alternate embodiments, the matable housing 116 may comprise so-called blind-mate, bayonet, or one-quarter-turn connector housings, each of which are available, for example, through Amphenol Incorporated.

When assembled, the electrical connector assembly 100 adaptively couples an RF signal from a first port to a second port. In a preferred embodiment, it is assumed that the solderable surface 114 of the second electrically conductive element 104 is soldered, or otherwise rigidly connected—for example, via conductive epoxy—to a substrate (not shown), such as a printed circuit board, which provides the first port. An incident RF signal enters the electrical connector assembly 100, via the second electrically conductive element 104, propagates through the compliant element 106, and exits the electrical connector assembly 100, via the first electrically conductive element 102. Typically, the threaded cylinder portion 112 of the matable housing 116 couples to an RF coaxial cable (not shown), which supplies the second, or load, port to the electrical connector assembly 100.

During operation of the electrical connector assembly 100, energy from the RF signal is absorbed in the center pin assembly 101 and the solder joint formed between the solderable surface 114 of the second electrically conductive 104 element and the printed circuit board. The absorbed energy heats the center pin assembly 101 and causes both electrically conductive elements 102, 104 to expand based on their coefficients of thermal expansion (CTE). For copper, a CTE of 14 parts per million per degrees Celsius (ppm/° C.) is typical. In a preferred embodiment, the compliant member 106 absorbs the axial forces produced by the expansion of the two electrically conductive elements 102, 104 by flexing inward about the center of the formed omega. Thus, the compliant member 106 provides mechanical stress relief within the center pin assembly 101 during increases in the center pin assembly's temperature.

In a similar manner, when the RF signal is removed from the center pin assembly 101, the center pin assembly 101 cools and the electrically conductive elements 102, 104 contract based on their respective CTEs. Accordingly, the compliant member 106 flexes substantially outward about its center, as the axial forces are reduced, until it reaches its original position. Thus, the compliant member 106 absorbs a significant portion of the mechanical stresses associated with temperature cycling of the center pin assembly 101 as RF energy is intermittently applied to either electrically conductive element 102, 104. In this manner, the electrical connector assembly 100 provides adaptive coupling of the RF signal during temperature variations of the center pin assembly. This adaptive coupling serves to transfer the mechanical stresses associated with the expansion and contraction of the electrically conductive elements; 102, 104 away from the solder joint using the compliant member 106. As a result, the present invention provides a more reliable RF connection between the first port and the second port due to the substantial reduction of solder joint stress in the solder joint that connects the second electrically conductive element 104 to the printed circuit board. Thus, the present invention obviates the solder joint failure that inevitably results from solder joint stresses produced by prior an connector assemblies.

FIG. 2 illustrates an alternate embodiment of the center pin assembly 101, in accordance with the present invention. The center pin assembly 200 comprises a first electrically conductive element 202, the second electrically conductive element 104, and a compliant member 206 that is operably coupled to both electrically conductive elements 202, 104. In this embodiment, the first electrically conductive element 202 comprises the aforementioned jack style pin, and the compliant member 206 comprises a cylindrically-shaped, electrically conductive braid as depicted in FIG. 2.

The present invention provides an electrical connector assembly for adaptively coupling an RF signal between two ports. With this invention, mechanical stress relief for expansion and contraction of the center pin assembly during temperature variations is incorporated within a matable connector assembly. Further, by including this mechanical stress relief via the compliant member, the present invention substantially reduces the mechanical stress presented to the solder joint used to provide electrical continuity between one portion of the center pin assembly and a substrate. By reducing the solder joint stress, the present invention insures a more reliable RF interconnection between the substrate and the matable connector assembly, as compared to the interconnection reliability provided by connector assemblies of the prior art.

I claim:

1. A mechanically stable electrical connector assembly for adaptively coupling a radio frequency signal between a first port and a second port, comprising:

a matable housing; and integrally-configured connection means for providing mechanical stress relief between the first port and the second port, comprising:

first electrically conductive means, disposed substantially within the matable housing, for coupling the radio frequency signal to the first port;

a circularly formed metal element having a solderable surface on one side thereof, the solderable surface coupling the radio frequency signal to the second port; and a cylindrically-shaped electrically conductive braid, coupled at a first end to the first electrically conductive means and coupled at a second end to the circularly formed metal element.

2. The electrical connector assembly of claim 1, further comprising a dielectric medium disposed substantially about the first electrically conductive means.

3. The electrical connector assembly of claim 1, wherein the first electrically conductive means comprises a jack.

4. The electrical connector assembly of claim 1, wherein the first electrically conductive means comprises a plug.

5. The electrical connector assembly of claim 1, wherein the first port comprises a coaxial cable and the second port comprises a printed circuit board.

6. The electrical connector assembly of claim 1, wherein the circularly formed metal element is a cylindrically formed metal element.

7. The electrical connector assembly of claim 1, wherein the matable housing comprises a metallic threaded cylinder portion.

8. The electrical connector assembly of claim 7, wherein the matable housing is an N-connector housing.

9. A mechanically stable electrical connector assembly for adaptively coupling a radio frequency signal between a first port and a second port, comprising:

a matable housing; and integrally-disposed connection means for providing mechanical stress relief between the first port and the second port, comprising:

an electrically conductive plug, disposed substantially within the matable housing, for coupling the radio frequency signal to the first port;

a cylindrically formed metal element having a solderable surface on one side thereof, the solderable surface coupling the radio frequency signal to the second port; and a cylindrically-shaped electrically conductive braid, connected at a first end to the electrically conductive plug and connected at a second end to the cylindrically formed metal element.

10. The electrical connector assembly of claim 9 further comprising a dielectric medium disposed substantially about the electrically conductive plug.

11. The electrical connector assembly of claim 9, wherein the matable housing comprises a threaded cylinder portion.

12. A mechanically stable electrical connector assembly for adaptively coupling a radio frequency signal between a first port and a second port, comprising:

a matable housing;

integrally-disposed connection means for providing mechanical stress relief between the first port and the second port, comprising:

an electrically conductive means, disposed substantially within the matable housing, for coupling the radio frequency signal to the first port;

a circularly formed metal element that includes a solderable surface on one side of the circularly formed metal element, the solderable surface coupling the radio frequency signal to the second port;

a cylindrically-shaped electrically conductive braid, connected to the electrically conductive means and the circularly formed metal element; and a dielectric medium disposed substantially about the electrically conductive means.

13. The electrical connector assembly of claim 12, wherein the circularly formed metal element is a cylindrically formed metal element.

14. A radio frequency electrical connector assembly, comprising:

a metallic matable housing having a first cylindrically-shaped opening substantially in a center thereof, the matable housing facilitating attachment to a coaxial cable;

a dielectric material being disposed within the first cylindrically-shaped opening, the dielectric material having a second cylindrically-shaped opening substantially in a center thereof; and a center pin assembly, comprising:

electrically conductive means positioned within the second cylindrically-shaped opening;

a cylindrically shaped electrically conductive braid positioned external to the dielectric material and connected at a first end to the electrically conductive means; and a cylindrically formed metal element having a solderable surface on an underside thereof and being positioned external to the dielectric material, the cylindrically formed electrically conductive element being connected to a second end of the cylindrically-shaped electrically conductive braid, and the solderable surface facilitating attachment to a printed circuit board.

15. A radio frequency connector assembly, comprising:

a radio frequency connector having a metallic matable housing, a dielectric material disposed within the matable housing, and a center pin disposed within the dielectric material, the matable housing being attachable to a coaxial cable;

a cylindrically-Shaped electrically conductive braid connected at a first end to the center pin of the radio frequency connector; and a circularly formed metal element connected to a second end of the cylindrically-shaped electrically conductive braid, the circularly formed metal element including a solderable surface on an underside thereof to facilitate attachment to a printed circuit board.

* * * * *